US005713409A

United States Patent [19]

Stilli

[11] Patent Number: 5,713,409

[45] Date of Patent: Feb. 3, 1998

[54] ARRANGEMENT FOR SUPPLYING STEEL INTO A CONTINUOUS CASTING MOULD

[75] Inventor: Adrian Stilli, Bülach, Switzerland

[73] Assignee: Concast Standard AG, Zurich, Switzerland

[21] Appl. No.: 567,024

[22] Filed: Dec. 4, 1995

[30] Foreign Application Priority Data

Dec. 16, 1994 [CH] Switzerland ..... 03 807/94

[51] Int. Cl.[6] ..... B22D 11/10; B22D 41/24

[52] U.S. Cl. ..... 164/437; 164/337; 222/600

[58] Field of Search ..... 164/437, 337, 164/488, 259, 415; 222/600

[56] References Cited

U.S. PATENT DOCUMENTS

| | | | |
|---|---|---|---|
| 3,352,465 | 11/1967 | Shapland | 222/512 |
| 5,111,980 | 5/1992 | Amsler | 164/437 |

FOREIGN PATENT DOCUMENTS

| | | | |
|---|---|---|---|
| 1 299 804 | 7/1969 | Germany . | |
| 2330113 | 1/1975 | Germany | 164/437 |
| 59-64153 | 4/1984 | Japan | 164/437 |

*Primary Examiner*—Joseph J. Hail, III
*Assistant Examiner*—I.-H. Lin
*Attorney, Agent, or Firm*—Darby & Darby

[57] ABSTRACT

In an arrangement for supplying steel from a base outlet of an intermediate vessel (2) in a continuous casting installation, the intermediate vessel (2) is provided with an outlet block (3). Beneath the outlet block (3) there is arranged a first change-over part (6) which is movable transversely to the discharge direction (4) and can be pushed out of the casting position by a moving arrangement (30) and a second change-over part (38). An arrangement of this type is to be improved in such a way that the casting nozzle body has a longer service life and is cheaper to produce. Furthermore, security on the casting platform is to be improved during interruptions in casting, the extraction speeds during continuous casting are to be altered and the positional accuracy of the outlet block is to be increased. For this purpose, the change-over part (6) is made up of a holding frame (12) and a casting nozzle body (11). The holding frame (12) is guided and positioned on guide strips (14) in guide rails (7, 7'). In the casting position, the holding frame (12) is connected to a gas circulation system (17), gas inlet apertures (21) on the guide strips (14) being brought into conformity with gas supply apertures (20) on the guide rails (7).

20 Claims, 3 Drawing Sheets

ARRANGEMENT FOR SUPPLYING STEEL INTO A CONTINUOUS CASTING MOULD

BACKGROUND OF THE INVENTION

The invention relates to an arrangement for supplying steel from a base outlet of an intermediate vessel into a continuous casting mould according to the preamble of claim 1.

It is known to supply molten steel from an intermediate vessel to one or more continuous casting moulds. With small billet cross sections, the steel can be supplied from an open base outlet without slide valve or stopper control directly to the mould. The service life of the refractory lining of the intermediate vessel is generally determined in sequential casting by the service life of the base outlet. If disturbances occur in the continuous casting installation during continuous casting, for example a breakout, open base outlets can be closed by a copper stopper. Re-opening can be carried out by deflagration with an oxygen lance so damage to the nozzle block and resultant unsatisfactory stream formation cannot be ruled out.

In order to overcome the aforementioned drawbacks, outlet nozzles are provided with stopper or slide valve control arrangements in continuous casting installations for billet and bloom cross sections.

A closure arrangement for an outlet block consisting of a slider plate is known from DE-AS 1 299 804, which forms the preamble of claim 1. On either side of the outlet block there are arranged open guide rails in which slider plates are guided transversely to the discharge direction and a first slider plate is ejected from the casting position and a second slider plate is brought into the casting position by means of a moving arrangement fastened on the periphery of the casting vessel.

The production of such a slider plate, of which the length and width correspond to five to ten times the casting nozzle diameter is expensive. The large gliding face which forms a slider face relative to the outlet block has to be ground with high precision. If such slider plates are reduced, they heat up together with their sheet metal shell, the gliding guides and their suspension means to such an extent that they are unserviceable after a relatively short time. Furthermore, the displacement path of the plates is imprecise in length which leads to unsatisfactory conformity between the orifice of the outlet block and the outlet aperture of the slider plate. Proposed stops to limit the sliding-in movement are not satisfactory either because they have to be removed before ejection of the old plate and have to be re-inserted during positioning of the new plate.

SUMMARY OF THE INVENTION

The object of the invention is to provide an arrangement for supplying steel from a base outlet of an intermediate vessel into a continuous casting mould which overcomes the above-mentioned drawbacks and, in particular, has a refractory casting nozzle body which ensures a long service life and also guarantees inexpensive production. However, the arrangement for supplying steel should also increase reliability during interruptions and allow reliable re-starting and casting at different extraction speeds during continuous casting. A further object resides in increased positional accuracy between the orifice of the outlet block on the intermediate vessel and the insertion position of the casting nozzle body.

According to the invention, this object is achieved by the sum of the features of claim 1.

The use of a mobile casting nozzle body allows rapid closure of the outlet aperture of an intermediate vessel and re-opening associated with few complications in emergencies. Furthermore, with long sequential casting, casting nozzles can be replaced if they are allowing an excessively large flow due to wear or if the nozzle apertures are beginning to clog owing to the deposition of aluminium oxide. With high-power continuous casting installations which operate at a substantially higher casting speed after an initial casting period, the casting capacities can easily be adapted to the instantaneously required casting parameters by the exchange of casting nozzles.

The air cooling of the holding frame allows a pronounced reduction of the casting nozzle body which, in turn, allows inexpensive production of such casting nozzles with close tolerances. The use of the mobile casting nozzle body also helps to optimize utilization of the intermediate vessels and therefore contributes to a reduction in costs and an increase in the capacity of the continuous casting installation.

The compressed gas supply can be connected to a compressed air network. If simultaneous shielding of the casting stream is desired, the gas circulation system can be connected to a nitrogen or inert gas supply instead of compressed air.

The moving arrangement for inserting the change-over parts can be fastened on a console connected to the casting vessel. To achieve accurate placing of the change-over part which, in particular, is independent of uncontrollable expansions on the casting vessel, it is proposed according to an embodiment that the guide rails, their suspension means and the moving arrangement be fastened on a base plate. This base plate can be designed to be easily mounted on and removed from the intermediate vessel.

The guidance between the holding frame and the guide rails can be designed as simple gliding guidance. According to a further embodiment, it is proposed that the guide strips be guided in groove-shaped guide tracks and that gas supply apertures be allowed to open into the grooves. The length of the groove of the guide strips is about twice as long as the length of a holding frame. The introduction of the second holding frame is therefore guaranteed.

The substantially right-angled or square holding frame has a conical receiving aperture for a conical casting nozzle body in the centre. Owing to the round configuration of the casting nozzle body, an annular sealing face which is as small as possible is formed between the casting nozzle body and the outlet block. The width of this annular sealing face is 0.5 to 1.5 times the average nozzle orifice according to an advantageous embodiment.

If the cast stream and the surface of liquid are shielded against atmospheric oxygen during casting, it is particularly advantageous if a sealing ring for a bellows encloses the guide rails on a base plate and a piston-cylinder unit is fastened on the base plate as a moving arrangement for the change-over parts outside the sealing ring. The sealing ring can have a reinforcing lug with an orifice for a piston rod of the piston-cylinder unit. In the rest position, the piston rod seals the orifice in the reinforcing lug against the admission of air into a space shielded by the bellows. Additional inlet and outlet pipes for the gas circulation system can be arranged in the reinforcing lug to cool the holding frame.

The bellows is generally fastened on the mould table and can be struck against the upper sealing ring by a raising and lowering device. If the holding frame is cooled with a protective gas, this cooling gas can be used as preheated protective gas in the bellows after the cooling of the holding frame.

The moving arrangement for the change-over parts can remain in its operating position during casting. To ensure unobstructed access and free sight for insertion of change-over parts into the guides, according to a further embodiment, the moving arrangement for the change-over parts can be suspended in an oscillating manner on an axis parallel to the axis of movement of the change-over part on a lever and can be pivotal round the axis between a rest position and an operating position.

BRIEF DESCRIPTION OF THE DRAWINGS

The invention will be additionally described hereinafter with reference to drawings.

DETAILED DESCRIPTION OF THE INVENTION

Figure 1:
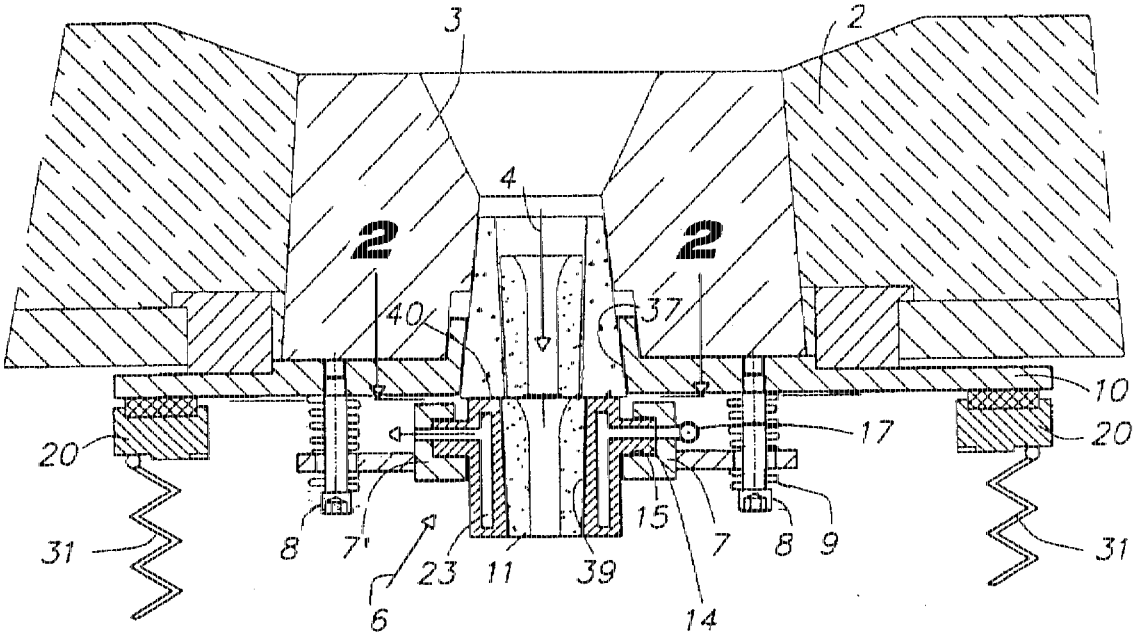
FIG. 1 is a vertical section through a base outlet of an intermediate vessel.

FIGS. 1 to 4 show an example of an arrangement for supplying steel from a base outlet, an intermediate vessel 2 only being shown by the embedding of an outlet block 3. An arrow 4 shows the discharge direction of the cast metal. A change-over part 6 is located in the casting position. Open guide rails 7, 7' are elastically connected to a base plate 10 by screws 8 and springs 9 on either side of this change-over part 6 or of the outlet block 3.

The change-over part 6 consists of a holding frame 12 made of steel which carries a casting nozzle body 11. The holding frame 12 is equipped with guide strips 14 which are guided in grooves 15 in the guide rails 7, 7'. To enable the guide rails 7, 7' to exert an elastic pressing force on the guide strips 14 or on the casting nozzle body in a direction toward the outlet block 3, they are elastically fastened on the base plate 10.

Figure 2:
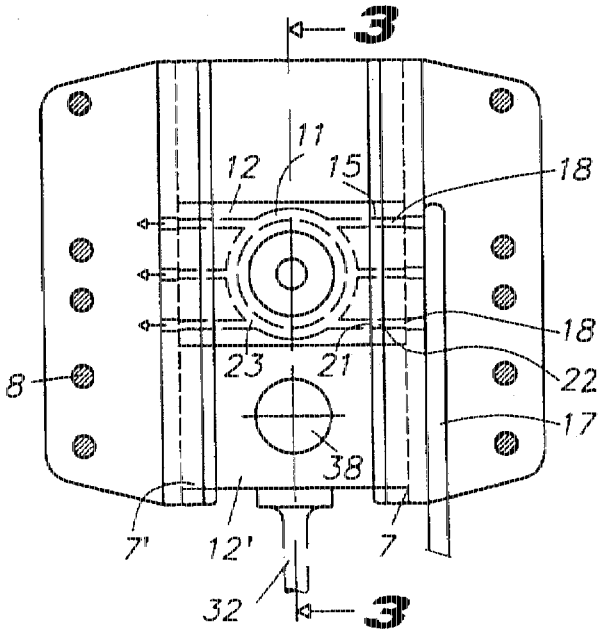
FIG. 2 is a section along line II—II in FIG. 1.

As shown most clearly in FIG. 2, the guide strip 14 is connected to a gas circulation system represented by a gas supply pipe 17. Gas is supplied from the gas supply pipe 17 via orifices 18 into the grooves 15 and via the guide strips 14 to cool the holding frame 12. When the holding frame 12 is in the casting position, the gas outlet apertures 21 of the guide strips correspond to the gas inlet apertures 22 of the guide rails. The cooling gas flows through a cooling groove 23 in the holding frame 12 and leaves it on the opposite side via the guide rail 7'. In this example, protective gas such as nitrogen or an inert gas flows into a space which is closed by a bellows 31. To enable the bellows 31 to provide a seal relative to the intermediate vessel, a sealing ring 20 which surrounds the guide rails 7, 7' is fastened on the base plate 10. Outside the sealing ring 20, a piston-cylinder unit 30 provided as a moving arrangement for the change-over parts is flanged on the base plate 10. A piston rod 32 of the piston-cylinder unit 30 is located in an orifice 33 in a reinforcing lug 34 of the sealing ring 20. In the rest position, the piston rod 32 seals the orifice 33 in the reinforcing lug 34 against the admission of air into a space shielded by the bellows 31. Supply and discharge pipes 36 (FIG. 4) for the gas circulation system can be arranged in the reinforcing lug 34 to cool the holding frame 12.

Figure 3:
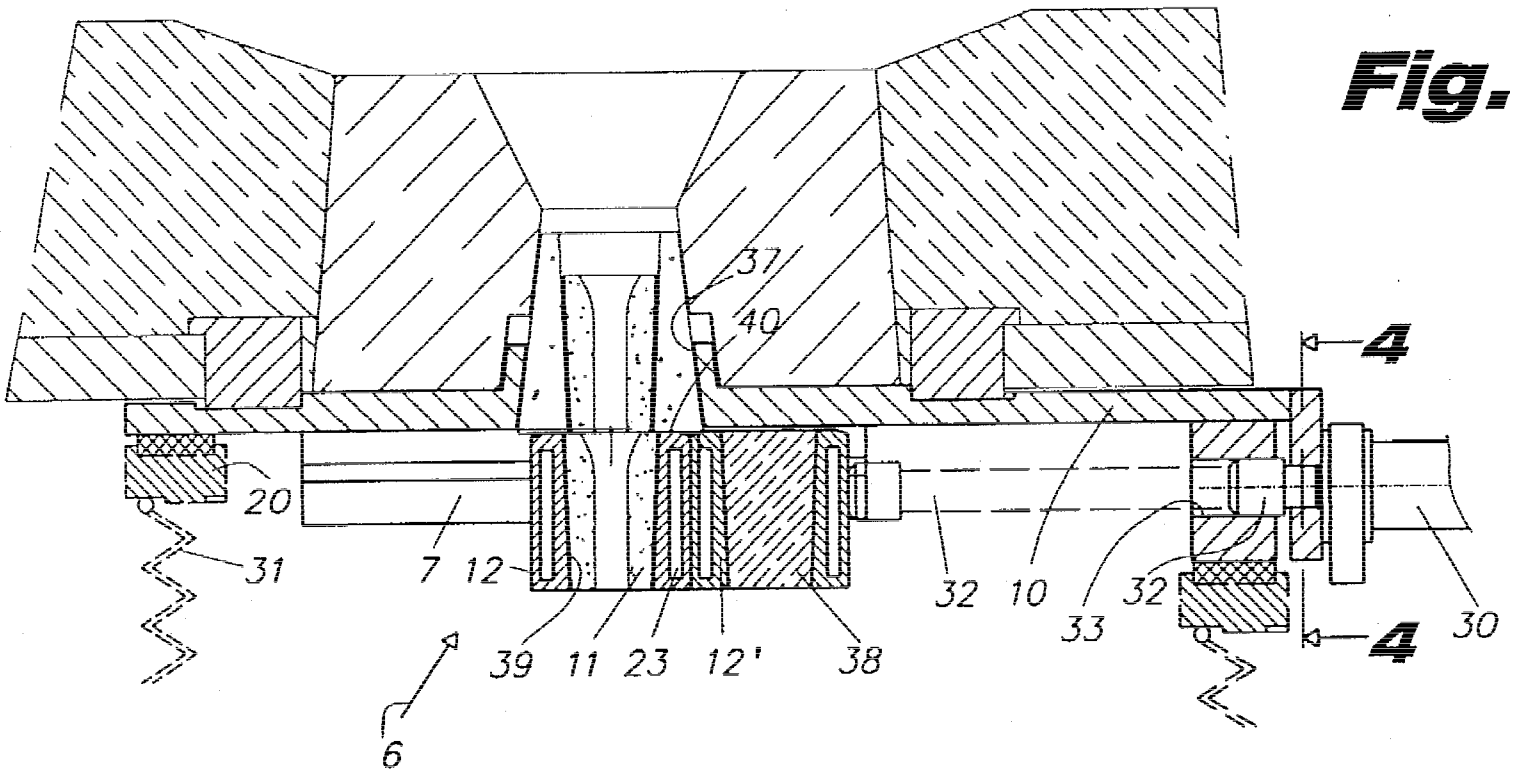
FIG. 3 is a section along line III—III in FIG. 2.
Figure 4:
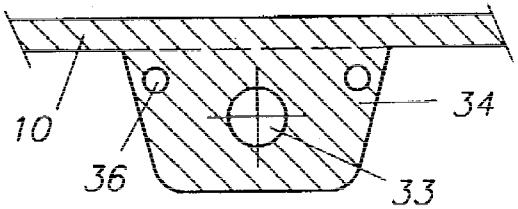
FIG. 4 is a section along line IV—IV in FIG. 3.

The bellows 31 merely indicated in FIGS. 1 and 3 and known from the prior art is fastened on the mould table and can be raised to the sealing ring 20 by a raising and lowering device. If an oxidation protective gas is used as cooling gas, the cooling gas can open within the bellows 31 after fulfilling the cooling function.

The entire change-over device is arranged on the base plate 10 which can easily be mounted on or removed from the intermediate vessel base by means of screws or wedges etc. A conical guide 37 for the centring and height positioning of the outlet block 3 is additionally provided on the base plate 10.

For accurate positioning of the casting nozzle body 11 or of an obstructing block 38, a conical receiving aperture 39 for a truncated cone shaped casting nozzle body 11 or obstructing block 38 is provided in the holding frame 12, 12'. The service life of the casting nozzle body 11 can be extended if the ratio of the diameter of the nozzle orifice to the height of the casting nozzle body is 1:2 to 1:5, preferably 1:3 to 1:4. The casting nozzle body can be extended in the context of the invention in such a way that the discharge orifice opens into a mould a few centimetres above the surface of liquid or also immersed in the liquid.

A sealing face 40 between the outlet block 3 and the casting nozzle body 11 is annular and can be machined as a high precision sealing face with little expenditure. The width of the annular face is 0.5 to 2 times, preferably 1 to 1.5 times the average nozzle orifice.

To obstruct the flow aperture, a holding frame which does not comprise a conical receiving aperture 39 can be inserted and flow obstruction takes place by means of a holding frame consisting of steel or grey cast iron with an attached or separate closure member. A holding frame of this type can also be connected to the gas circulation system and is proposed for repeated use.

Figure 5:
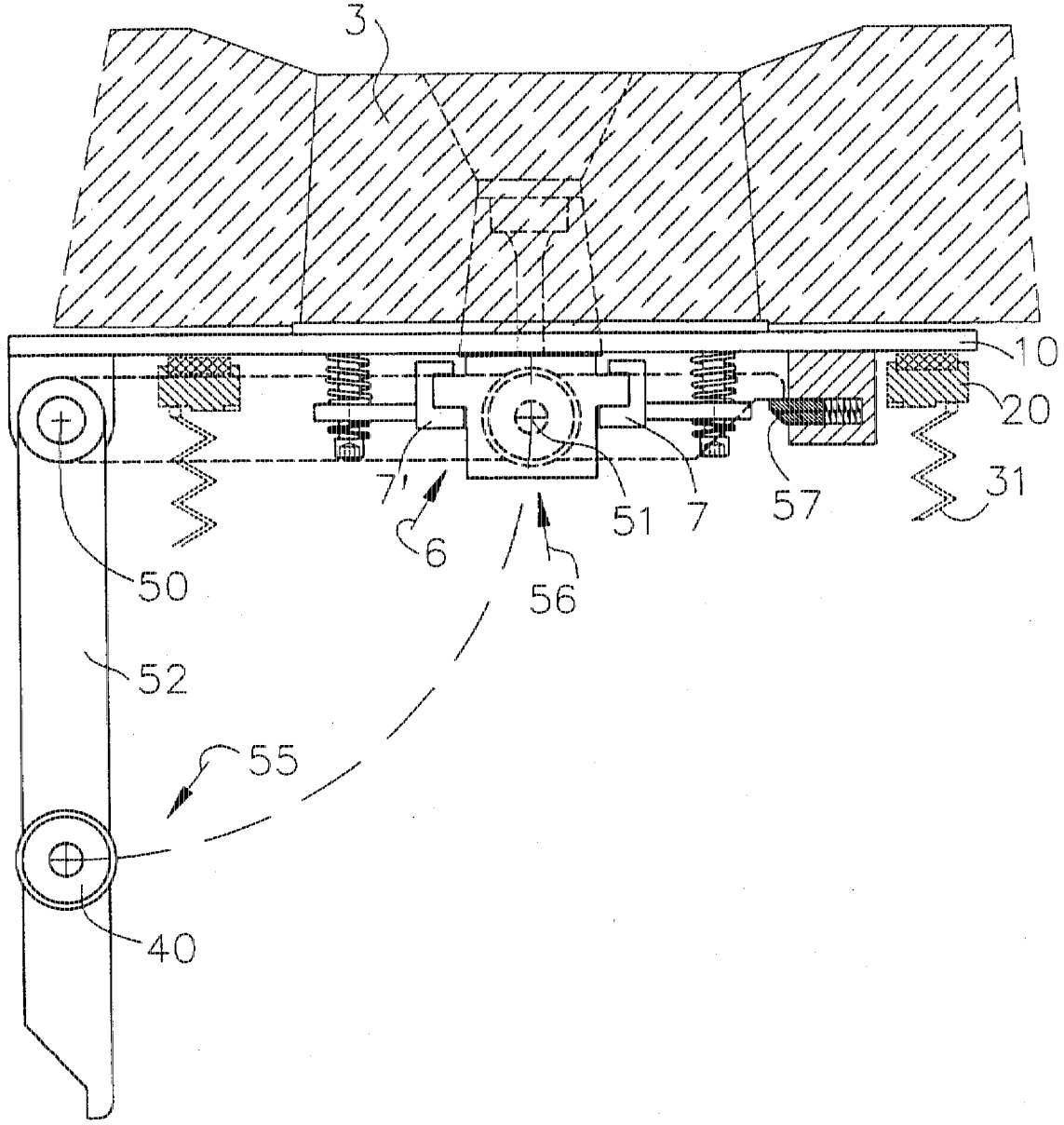
FIG. 5 is an elevation/section of a suspension means for the moving arrangement for the change-over part.

In FIG. 5, the same reference numerals as in FIGS. 1 to 3 are used for identical parts. In contrast to FIG. 3, the moving arrangement, which is designed, for example, as a piston-cylinder unit 30, is pivotal from its operating position 56 into a rest position 55. For this purpose, a lever 52 is suspended in an oscillating manner on an axis 50 which is arranged parallel to the axis of movement 51 of the change-over part 6. The piston-cylinder unit 30 is fastened on this lever 52. If a new change-over part is to be placed beneath the casting outlet, the bellows 31 is lowered to obtain access to the open guide rails 7, 7'. After manual introduction of the new change-over part 6 into the open guide rails 7, 7', the lever 52 with the piston-cylinder unit 30 is pivoted into the operating position 56, as shown in broken lines, just before the exchange of the change-over part 6 and is secured by the securing arrangement 57. After exchanging the new change-over part for the old 6, the piston-cylinder unit 30 is pivoted back into the rest position and the bellows 31 is brought back into the sealing position. The pivot axis 50 is advantageously arranged outside the bellows 31. Depending on the local space conditions, a vertical axis could be provided for pivoting the piston-cylinder unit 30 instead of the horizontal pivot axis 50.

I claim:

1. An arrangement for supplying steel from a base outlet of an intermediate vessel having an outlet block into a continuous casting mould, said arrangement comprising:

open guide rails arranged on both sides of the outlet block; and a change-over part comprising a refractory casting nozzle body and a holding frame for the casting nozzle body, said holding frame having guide strips shaped for engaging said guide rails said, guide strips having gas inlet apertures for receiving gas for cooling said holding frame.

2. An arrangement according to claim 1, wherein said guide rails apply an elastic pressing force in the direction of the outlet block.

3. An arrangement according to claim 2, further comprising:

a base plate removably mounted on the intermediate vessel; and a suspension means fastened on said base plate, said guide rails being mounted on said suspension means.

4. An arrangement according to claim 3, further comprising:

a bellows;

a sealing ring for said bellows surrounding said guide rails on said base plate; and a piston-cylinder unit fastened on said base plate outside said sealing ring, said piston-cylinder unit serving as a moving arrangement for said change-over part.

5. An arrangement according to claim 1, wherein said sealing ring has a reinforcing lug with an orifice for a piston rod of said piston-cylinder unit and, in a rest position, seals the orifice in said reinforcing lug by the piston rod against the admission of air into a space shielded by said bellows.

6. An arrangement according to claim 5, wherein said holding frame is in fluid communication with a gas circulation system, said reinforcing lug further comprising supply and discharge lines in fluid communication with the gas circulation system to cool said holding frame.

7. An arrangement according to claim 3, wherein said base plate has a conical guide for the centering and height positioning of the outlet block.

8. An arrangement according to claim 3, wherein said holding frame is connected to a gas circulation system and said gas circulation system is connected to a nitrogen or inert gas supply.

9. An arrangement according to claim 4, wherein said bellows further comprises a raising and lowering device.

10. An arrangement according to claim 1, wherein said guide rails have groove-shaped guide tracks and gas supply apertures opening into said grooves.

11. An arrangement according to claim 1, wherein said holding frame has a conical receiving aperture for one of a conical casting nozzle body and an obstructing block, said holding frame further comprising a cooling groove extending concentrically to the receiving aperture.

12. An arrangement according to claim 10, wherein the length of said groove of said guide rails corresponds to twice the length of said holding frame.

13. An arrangement according to claim 1, wherein an orifice is defined in said nozzle and the height of said casting nozzle body corresponds to at least three times the diameter of the nozzle orifice.

14. An arrangement according to claim 1, wherein said casting nozzle body has an annular sealing face opposite the outlet block.

15. An arrangement according to claim 14, wherein an orifice is defined in said nozzle and the width of said annular sealing face is 0.5 to 1.5 times the average nozzle orifice.

16. An arrangement according to claim 1, further comprising a moving arrangement for said change-over part, said moving arrangement being suspended in an oscillating manner on a lever, said lever being pivotable about an axis parallel to the movement axis (51) of said change-over part between a rest position and an operating position.

17. An arrangement according to claim 1, wherein said guide rails have gas outlet apertures coinciding with said gas inlet apertures of said guide strips.

18. An arrangement according to claim 17, wherein said guide rails further comprise gas supply apertures in fluid communication with said gas outlet apertures, said arrangement further comprising a gas circulation system in fluid communication with said gas supply apertures of said guide rails.

19. An arrangement according to claim 1, wherein said holding frame has a cooling groove in fluid communication with said gas inlet apertures of said guide strips.

20. A change-over pan for use in arrangement for supplying steel from a base outlet of an intermediate vessel having an outlet block into a continuous casting mould, the arrangement having open guide rails arranged on both sides of the outlet block, said change-over part comprising:

a refractory casting nozzle body; and a holding frame for the casting nozzle body, said holding frame having guide strips said guide strips being shaped for engaging the guide rails and having gas inlet apertures.

* * * * *

UNITED STATES PATENT AND TRADEMARK OFFICE

CERTIFICATE OF CORRECTION

PATENT NO. : 5,713,409

DATED : February 3, 1998

INVENTOR(S) : Adrian STILLI

It is certified that error appears in the above-identified patent and that said Letters Patent is hereby corrected as shown below:

On the title page, item [30], Foreign Application Priority Data, change "03 807/94" to --03 807/94-8--.

Signed and Sealed this

Twenty-eighth Day of April, 1998

Bruce Lehman

*Attest:*

BRUCE LEHMAN

*Commissioner of Patents and Trademarks*

*Attesting Officer*